US006404404B1

(12) United States Patent
Chen et al.

(10) Patent No.: US 6,404,404 B1
(45) Date of Patent: Jun. 11, 2002

(54) DENSITY TAPERED TRANSMIT PHASED ARRAY

(75) Inventors: Chun-Hong Harry Chen; Steven Szu-Cherng Kuo, both of Torrance; Te-Kao Wu, Rancho Palos Verdes, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/628,523

(22) Filed: Jul. 31, 2000

(51) Int. Cl.[7] ..... H01Q 21/00

(52) U.S. Cl. ..... 343/844; 343/853; 381/92

(58) Field of Search ..... 343/754, 756, 343/844, 853, 893, 895; 381/92; H01Q 21/00

(56) References Cited

U.S. PATENT DOCUMENTS

| | | | | | |
|---|---|---|---|---|---|
| 3,811,129 | A | * | 5/1974 | Holst | 343/844 |
| 4,499,473 | A | * | 2/1985 | Rao | 343/754 |
| 4,797,682 | A | * | 1/1989 | Klimczak | 343/844 |
| 6,025,224 | A1 | * | 3/2001 | Underbrink | 343/893 |

OTHER PUBLICATIONS

M.I. Skolnik, "Nonuniform arrays", *Antenna Theory,* R.E. Collin and F.J. Zucker, Ed, N.Y., McGraw–Hill, 1969, Part I, Ch. 6, pp. 207–234.

R.E. Willey, "Space Tapering of Linear and Planar Arrays", *IRE Transactions on Antennas and Propagation,* vol. AP–10, No. 3, May 1962, pp. 369–377.

J.W. Sherman and M.I. Skolnik, "Thinning Planar Array Antennas with Ring Arrays", *1963 International Convention Record,* Part 1 Antennas and Propagation, pp. 77–86.

M.I. Skolnik and J.W. Sherman, "Planar Arrays with Unequally Spaced Elements", *The Radio and Electronic Engineer,* vol. 28, No. 3, Sep. 1964, pp. 173–184.

* cited by examiner

*Primary Examiner*—Tho Phan
(74) *Attorney, Agent, or Firm*—Harness, Dickey & Pierce, P.L.C.

(57) ABSTRACT

A phased antenna array (60) for use on a satellite, that employs a density tapering technique for positioning the antenna elements (62) in the array (60) to reduce co-channel interference between adjacent cells. Particularly, the spatial position of the various antenna elements (62) in the array (60) are spread out so that the center portion of the array (60) has the highest density of elements (62), and the outer portion of the array (60) has the lowest density of elements (62). Predetermined schemes are used to set the density of the elements (62) in the array (60). By providing fewer antenna elements (62) at the outer portion of the array (60), the beam side lobes are reduced.

10 Claims, 6 Drawing Sheets

DENSITY TAPERED TRANSMIT PHASED ARRAY

BACKGROUND OF THE INVENTION

1. Field of the Invention

This invention relates generally to a satellite communications system employing a phased antenna array that provides reduced co-channel interference and, more particularly, to a satellite communications system that employs a phased antenna array having a plurality of antenna elements, where the spatial distribution of the elements has a density taper to reduce beam side lobes and co-channel interference.

2. Discussion of the Related Art

Various communications systems, such as certain cellular telephone systems, cable television systems, internet systems, military communications systems, etc., make use of satellites orbiting the Earth to transfer signals, usually in the form of digital data modulated onto a carrier wave. A satellite uplink communications signal is transmitted to the satellite from one or more ground stations, and then is retransmitted by the satellite to another satellite or to the Earth as a satellite downlink communications signal to cover a desirable reception area depending on the particular use. The satellite is equipped with an antenna system, such as a phased antenna array system, including one or more arrays of antenna elements or feed horns that receive the uplink signals and transmit the downlink signals to the Earth.

FIG. 1 is a schematic block diagram of a transmit phased antenna array system 10 that includes an antenna array 12 having a plurality of array elements 14 for use on a satellite. Each array element 14 includes a phase shifter 16, a high power amplifier 18, such as a traveling wave tube amplifier (TWTA) or a solid-state power amplifier (SSPA), a resistor 20, and an antenna element 22, such as a feed horn. Only seven antenna elements are shown in this example, but as will be appreciated by those skilled in the art, a typical antenna array will include many antenna elements configured in a predetermined geometric pattern, such as a hexagon or circle. The system 10 includes a source 24 that generates a signal to be transmitted. The signal is sent to a beam forming network (BFN) 26 that distributes the signal to each of the separate array elements 14. The phase shifters 16 set each of the separated signals to a predetermined phase progression and the amplifiers 18 amplify the signals for transmission. The antenna elements 22 may also generate beams for other downlink signals.

Each feed horn directs a separate beam at a certain frequency and at a certain beam intensity. A predetermined combination of the feed horns directs a specific downlink signal to a predetermined coverage cell within a reception area. Each downlink signal will include a main lobe directed to the coverage cell and side lobes that may be directed towards the coverage cell of the main lobe of another downlink signal. If the frequency of the two downlink signals is the same, the side lobes may cause co-channel interference (CCI) with the other cell in the reception area depending on the intensity of the side lobes. The CCI needs to be controlled to minimize bit error rate and maximize the channel data rate and system capacity. By reducing the CCI, the isolation between adjacent cells can be increased.

To illustrate this situation, FIG. 2 shows a diagrammatic view of a satellite 30 emitting a plurality of downlink beams 32 from a satellite antenna system 34, such as a transmit phased array (TPA) of the type discussed above, to a reception area 36 on the Earth. The downlink beams 32 include a main lobe 38 and side lobes 40. The main lobes 38 are directed towards a particular cell 42 in the reception area 36. The side lobes 40 may be directed towards the cell 42 for another main lobe. The shape of the combination of the antenna elements 22 transmitting the downlink signal determines the shape of the cell 42. In this view, the cells 42 are circular shaped but other cell shapes can also be generated, as would be understood to those skilled in the art.

The downlink beams 32 are required to be within a particular frequency band based on FFA requirements. Within that frequency band, sub-frequency bands are used to transmit the various beams 32 carrying the digital data. It is desirable to make the sub-frequency bands as wide as possible so that they are able to carry more information, such as for multi-media applications. However, the side lobes 40 of one beam 32 may interfere with the beam 32 for another cell 42 if the beams are using the same sub-frequency band. By using different sub-frequency bands for cells that are adjacent or proximate each other, the CCI can be significantly reduced or eliminated. However, as the bandwidth of the various sub-frequency bands decreases, the amount of information that can be transmitted is limited. Therefore, it is desirable to suppress the side lobes 40 and provide more frequency reuse for adjacent or proximate cells.

For phased array antenna elements, the traditional or conventional technique for reducing beam side lobes and CCI is to employ an amplitude-tapering scheme. In amplitude tapering, the various antenna elements in each array have an output intensity or amplitude that is selected based on its location in the array. Particularly, the centrally positioned antenna elements have the highest intensity output, and as the elements get farther from the center of the array, their intensity output is decreased. Therefore, the elements at the outside of the array have less radiating energy, which reduces the energy of the side lobes, which in turn reduces the co-channel interference for those downlink signals using the same frequency band. Various amplitude tapering algorithms are known in the art for determining the actual intensity output of a particular feed horn depending on its location in the array for different applications. Additionally, by providing a tapered amplitude of the beam in this manner, the width of the main lobe increases.

Amplitude tapering of the type described above suffers from a number of drawbacks. In one amplitude tapering scheme, different power amplifiers are used for the antenna elements to generate the beams of different intensities to establish the amplitude tapering. Because different amplifiers are required for different amplitudes, a wide variety of amplifier designs are employed in each antenna array. However, the cost of the array increases as the number of amplifier designs increases.

In an alternate amplitude tapering scheme, resistors, for example the resistors 20, are used to attenuate the power output of the particular antenna element to provide the amplitude tapering. In this design, each antenna element employs the same amplifier so that the design is consistent, thus realizing cost savings. However, because power on a satellite is an important resource, it is undesirable to throw away power by using attenuating resistors. If the resistor is positioned before the amplifier, the efficiency of the amplifier may be reduced because it does not operate at its saturation point as is desirable.

Although amplitude tapering has been effective for reducing CCI, the drawbacks discussed above have caused phased antenna array designers to investigate additional ways to reduce CCI. It is desirable that all of the power amplifiers be the same for cost efficiency reasons and it is desirable to operate all of the amplifiers in their saturation regions without throwing power away. It is therefore an object of the present invention to provide an improved antenna array to reduce CCI.

SUMMARY OF THE INVENTION

In accordance with the teachings of the present invention, a phased antenna array for use on a satellite is disclosed that employs a density tapering technique for positioning the antenna elements in the array to reduce co-channel interference between cells. Particularly, the spatial position of the various antenna elements in the array are spread out so that the center portion of the array has the highest density of elements, and the outer portion of the array has the lowest density of elements. Predetermined schemes are used to set the spatial density of the elements in the array. By providing fewer antenna elements at the outer portion of the array, the beam side lobes are reduced.

Additional objects, features and advantages of the present invention will become apparent from the following description and appended claims, taken in conjunction with the accompanying drawings.

DETAILED DESCRIPTION OF THE PREFERRED EMBODIMENTS

The following discussion of the preferred embodiments directed to a density-tapered transmit phased antenna array is merely exemplary in nature, and is in no way intended to limit the invention or its applications or uses. Particularly, the discussion below includes using the phased array in connection with a satellite communications system. However, the density tapered array of the invention may have applications for other communications systems.

Figure 1:
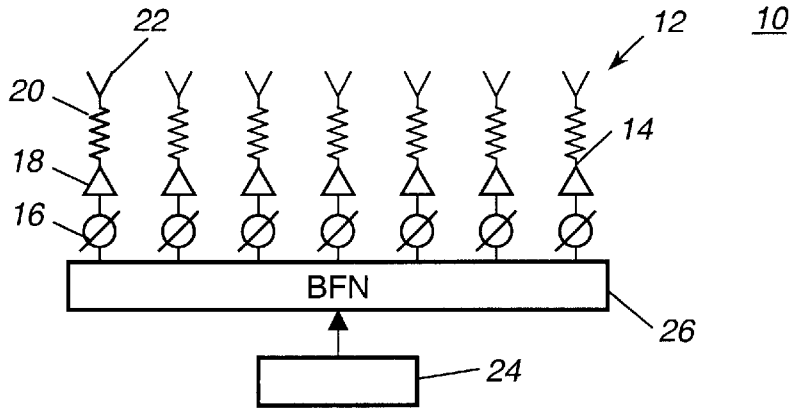
FIG. 1 is a schematic block diagram of a transmit phased antenna array.
Figure 2:
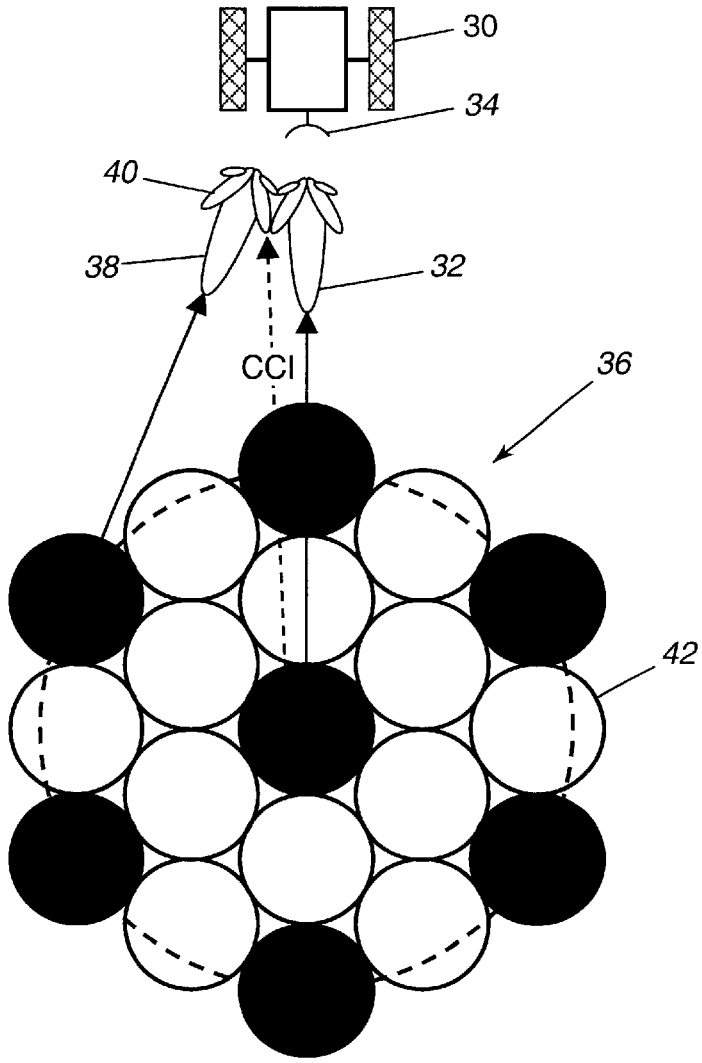
FIG. 2 is a diagrammatic view of downlink beams being emitted from a satellite to a particular coverage area on the Earth.
Figure 3:
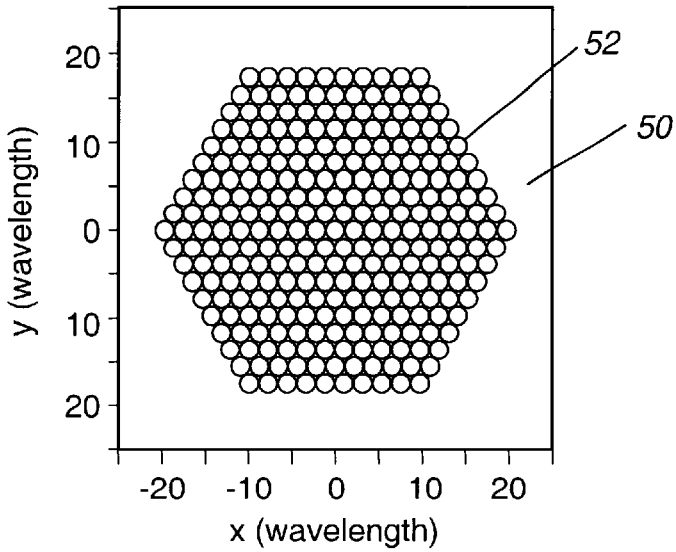
Fig. 3 (Prior Art)
FIG. 3 is an illustration of the layout of the antenna elements in a known uniform hexagonal phased antenna array.

FIG. 3 is an illustration of an array 50 of antenna elements 52 in a hexagonal pattern, where the elements 52 have a uniform taper in position. The array 50 is being viewed from a signal emitting end of the array 50. The spatial pattern shows each of the elements 52 contiguous with each other where the density of the elements 52 is consistent across the entire array 50. In this example, the side lobes are suppressed by reducing the amplitude of the signals emitted from the elements 52 at an outer parameter of the array 50, as discussed above.

Figure 4:
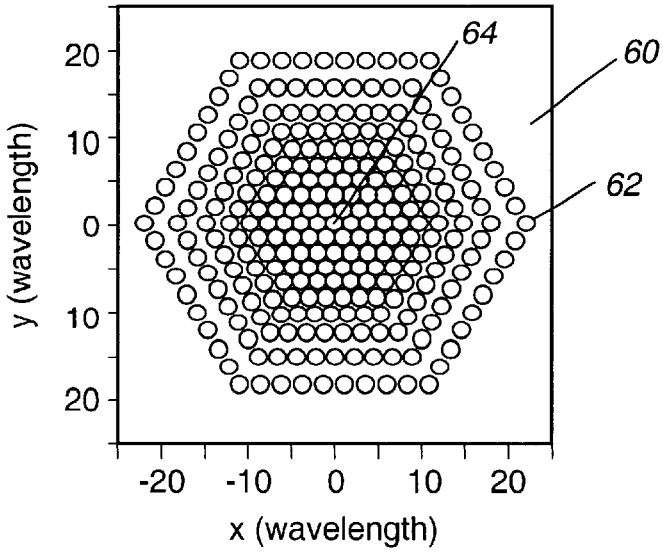
FIG. 4 is an illustration of the layout of the antenna elements in a density-tapered hexagonal phased antenna array, according to an embodiment of the present invention.

According to the invention, side lobe level (SLL) and co-channel interference is reduced in a phased antenna array by a density tapering technique, instead of the known amplitude tapering technique. FIG. 4 shows an illustration of an antenna array 60 including a plurality of antenna elements 62 arranged in a hexagonal pattern, as shown. The array 60 is density-tapered in that the spatial position of the elements 62 at the center of the array 60 are more closely spaced together than the elements 62 at the outer edge of the array 60. In this embodiment, there are nine concentric hexagonal rings of elements 62 around a center element 64, where the inner five rings are substantially contiguous with each other and the outer four rings get progressively farther apart moving from the center of the array 60 towards the outer edge. Other arrays may include more or less rings of elements within the scope of the present invention.

In this array configuration, each element 62 generates the same signal intensity, but the outer portion of the array 60 generates less signal intensity because there are less elements 62, and the center portion of the array 60 generates a greater signal intensity because there are more antenna elements 62. Therefore, the side lobe level of the combined beam generated by the array 60 is reduced without the need to provide amplitude tapering. Thus, common power amplifiers can be used for each element 62, and attenuation resistors are not needed to reduce the signal intensity of the outer elements. The array 60 includes the same number of elements as the array 50, and therefore takes up slightly more space. However, the benefits realized by the advantages discussed above outweigh the increased space requirements.

Figure 5:
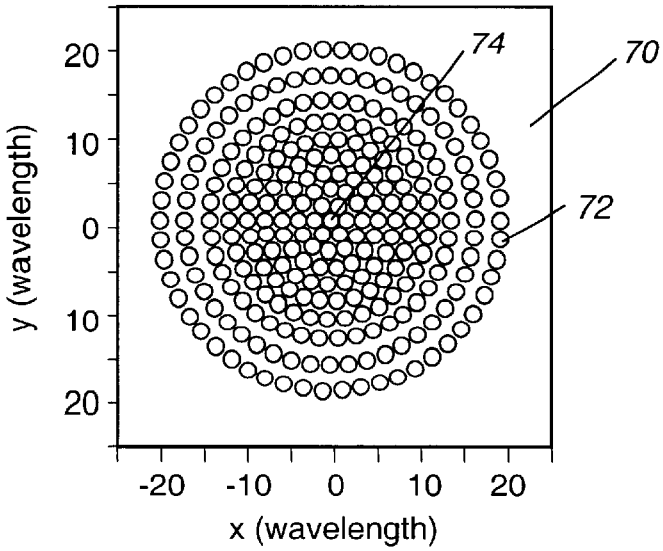
FIG. 5 is an illustration of the layout of the antenna elements in a density-tapered circular phased antenna array, according to another embodiment of the present invention.

The density tapering of the invention can be extended to other phased arrays that are not hexagonal in shape. FIG. 5 is an illustration of a phased antenna array 70 including a plurality of antenna elements 72, where the array 70 has a circular pattern. As with the array 60 above, the array 70 includes concentric circular rings of the elements 72 around a center element 74, where the rings are spaced farther apart from each other moving from an inner portion of the array 72 to an outer edge of the array 70. The inner five rings are tightly packed together, and then the ring spacing gets increasingly farther apart for the last four rings. Other array patterns can also be employed besides hexagonal and circular, including square arrays and elliptical arrays.

Various techniques can be used to determine the element spacing in the density tapered element configuration according to the invention. In one embodiment, the element spacing is determined in the following manner. First, a maximum allowable radius $r_{max}$ is determined for the entire array and an initial spacing d for the elements is determined.

The inner ring $r_1$ of elements is set to zero and the number of antenna elements is set to one. Then, the radius of each ring of elements is determined by:

$$r_{n+1} = r_n + \frac{d}{f(r_n)}$$

where $r_n$ is the radius of the n-th ring and $f(r_n)$ is the Taylor amplitude distribution at $r_n$. In this example, the number of the elements in the n-th ring is equal to 6×(n−1). The coordinates of each element is determined in either the hexagonal or circular arrangement. In the case of a circular array, the number of elements in the n-th ring is the same as that of a hexagonal array.

Table 1 compares the performance of uniform-tapered, amplitude-tapered and density-tapered TPAs that delivers the same 60 dBW EIRP. Each amplifier associated with each element is operated in the saturation region for maximum efficiency. For the amplitude-tapered TPA, both single SSPA and multiple SSPA approaches are provided. The uniform-tapered TPA has a maximum SLL of −16 dB that is improved by both the amplitude-tapered and density-tapered TPA. The single SSPA amplitude-tapered TPA, however, has poor power efficiency that consumes more spacecraft power and burdens thermal management systems. The multiple SSPA amplitude tapered TPA requires an SSPA that can deliver 2 dB higher power than the one used in the density-tapered TPA, in addition to the multiple SSPA designs required. On the other hand, the density-tapered TPA offers low side lobe radiation patterns, while maintaining a single design of SSPA with high power efficiency.

TABLE 1

| | Uniform Taper | Amplitude Taper (Single SSPA Design) | Amplitude Taper (Multiple SSPA Designs) | Density Taper |
|---|---|---|---|---|
| EIRP | 60 dBw | 60 dBw | 60 dBw | 60 dBw |
| Relative Size | 1.00 | 1.09 | 1.09 | 0.99 |
| SLL | −16 dB | −23 dB | −23 dB | −29 dB |
| Efficiency | 25.0% | 10.0% | 25.0% | 25.0% |
| Max. SSPA Power | 30 dBm | 32 dBm | 32 dBm | 30 dBm |
| # of SSPA Designs | 1 | 1 | 9 | 1 |

Figure 6:
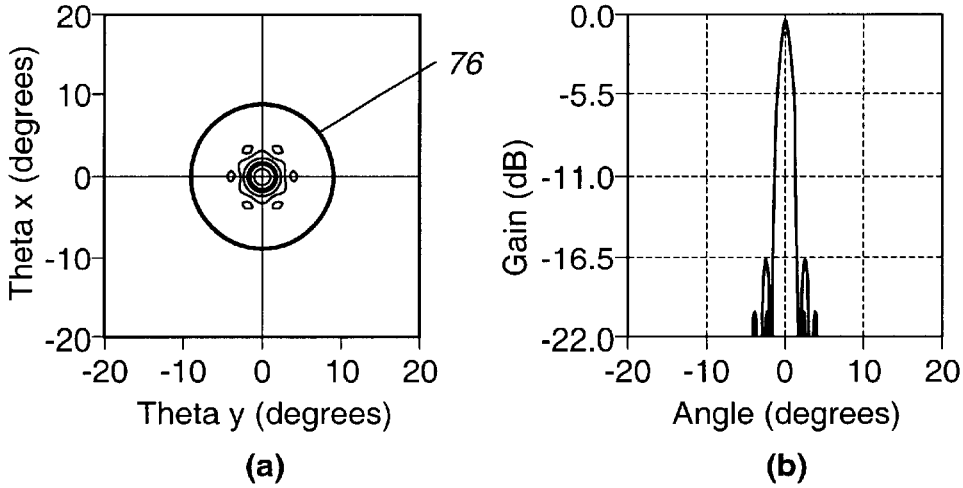
FIGS. 6(*a*) and 6(*b*) show boresight radiation patterns for a uniform-tapered, hexagonal array.
Figure 7:
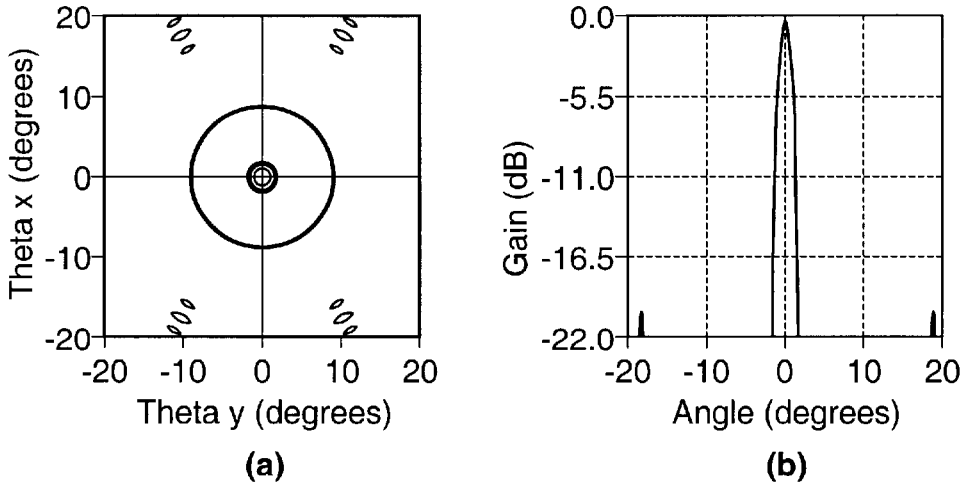
FIGS. 7(*a*) and 7(*b*) show boresight radiation patterns for a density-tapered, hexagonal antenna element array, according to the invention.
Figure 8:
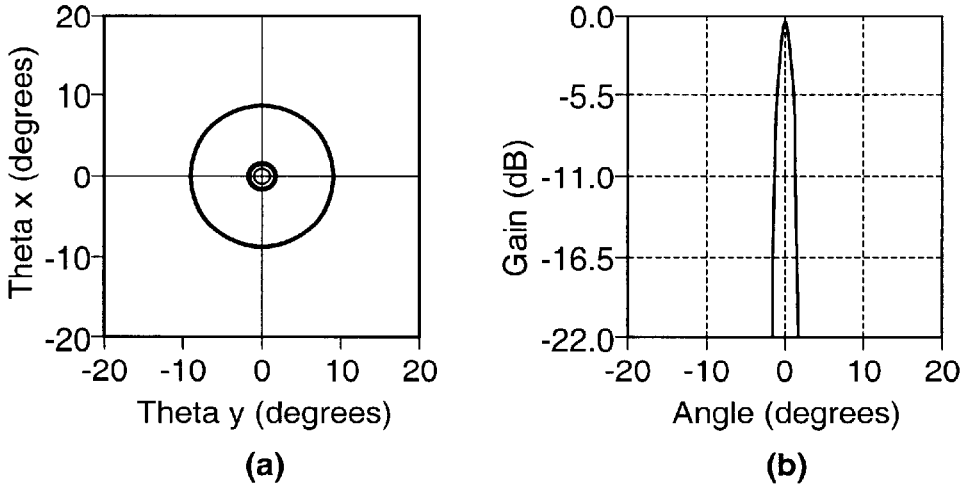
FIGS. 8(*a*) and 8(*b*) show boresight radiation patterns for a density-tapered, circular antenna element array, according to the invention.

FIGS. 6–8 show boresight radiation patterns for a uniform-tapered hexagonal phased antenna array, a density-tapered hexagon phased antenna array and a density-tapered circular phased antenna array, respectively. Each of FIGS. 6(*a*)–8(*a*) show the boresight contour in $\theta_x$ and $\theta_y$ degrees, where the circle 76 represents the edge of the Earth as viewed from the satellite. FIGS. 6(*b*)–8(*b*) show the cut pattern signal radiation pattern in degrees on the horizontal axis and gain in dB on the vertical axis.

Figure 9:
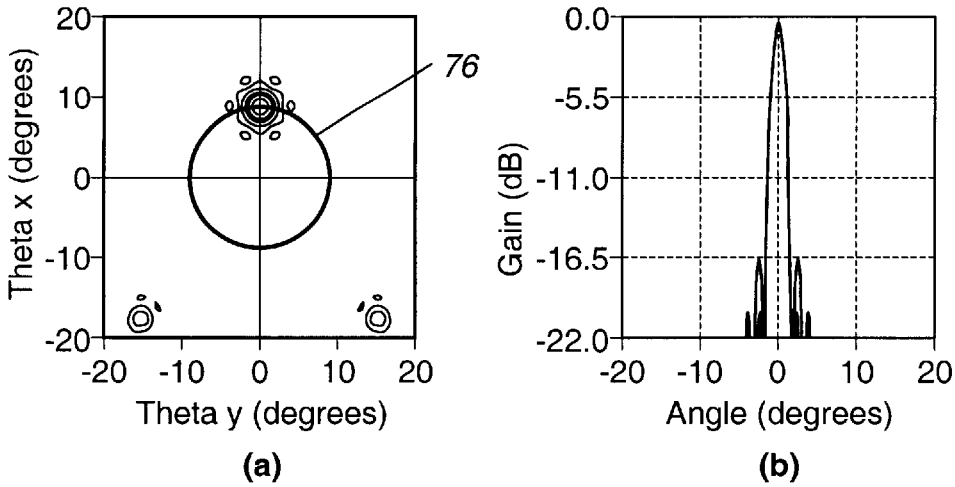
FIGS. 9(*a*) and 9(*b*) show 9° scan radiation patterns for a hexagonal antenna element array having a uniform taper.
Figure 10:
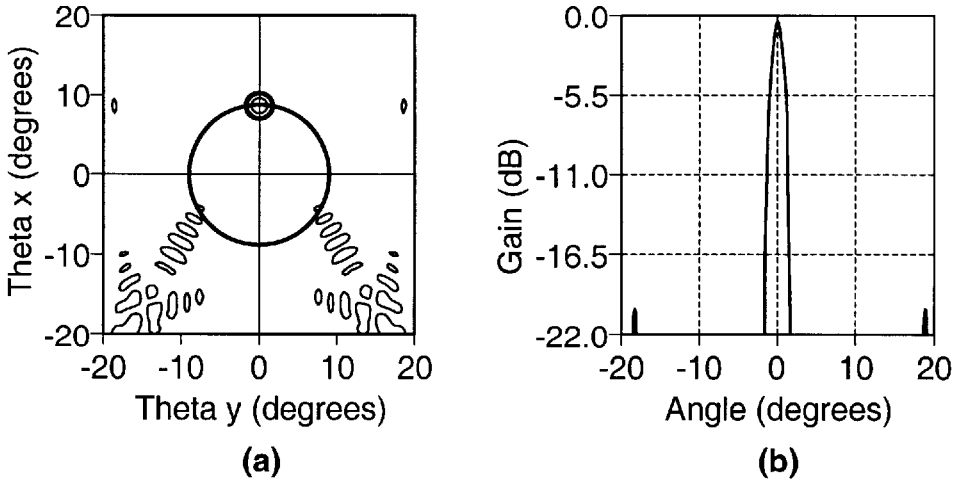
FIGS. 10(*a*) and 10(*b*) show 9° scan radiation patterns for a hexagonal antenna element array having a density taper, according to an embodiment of the present invention.
Figure 11:
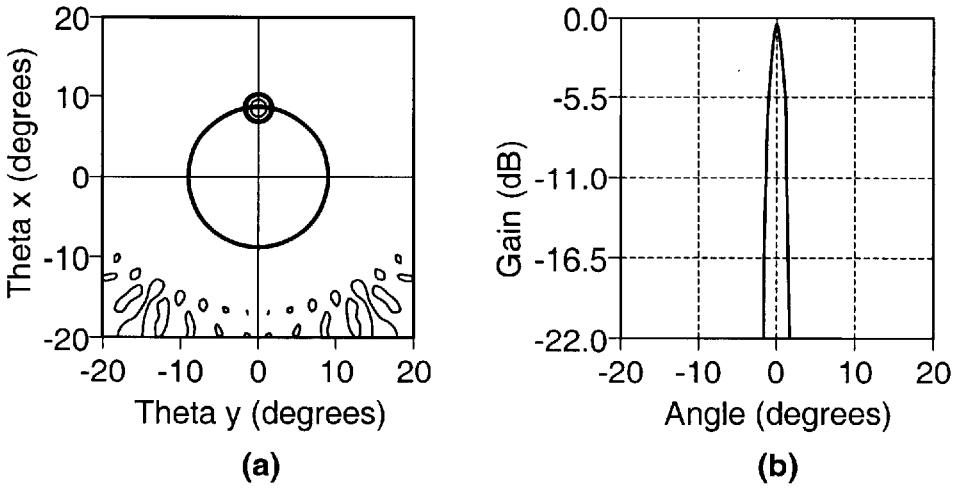
FIGS. 11(*a*) and 11(*b*) show 9° scan radiation patterns for a circular antenna element array having a density taper, according to an embodiment of the present invention.

FIGS. 9–11 show 9° scan contours for a uniform-tapered hexagonal antenna array, a density-tapered hexagonal antenna array, and a density-tapered circular antenna array, respectively. FIGS. 9(*a*)–11(*a*) show the 9° scan contour in $\theta_x$ and $\theta_y$ degrees, and FIGS. 9(*b*)–11(*b*) show the cut pattern signal radiation pattern in degrees on the horizontal axis and gain in dB on the vertical axis. It is clear that the density-tapered array suppresses near-in sidelobes and spreads the energy outside the Earth field-of-view, where the side lobes will not interfere with adjacent co-channel regions.

Figure 12:
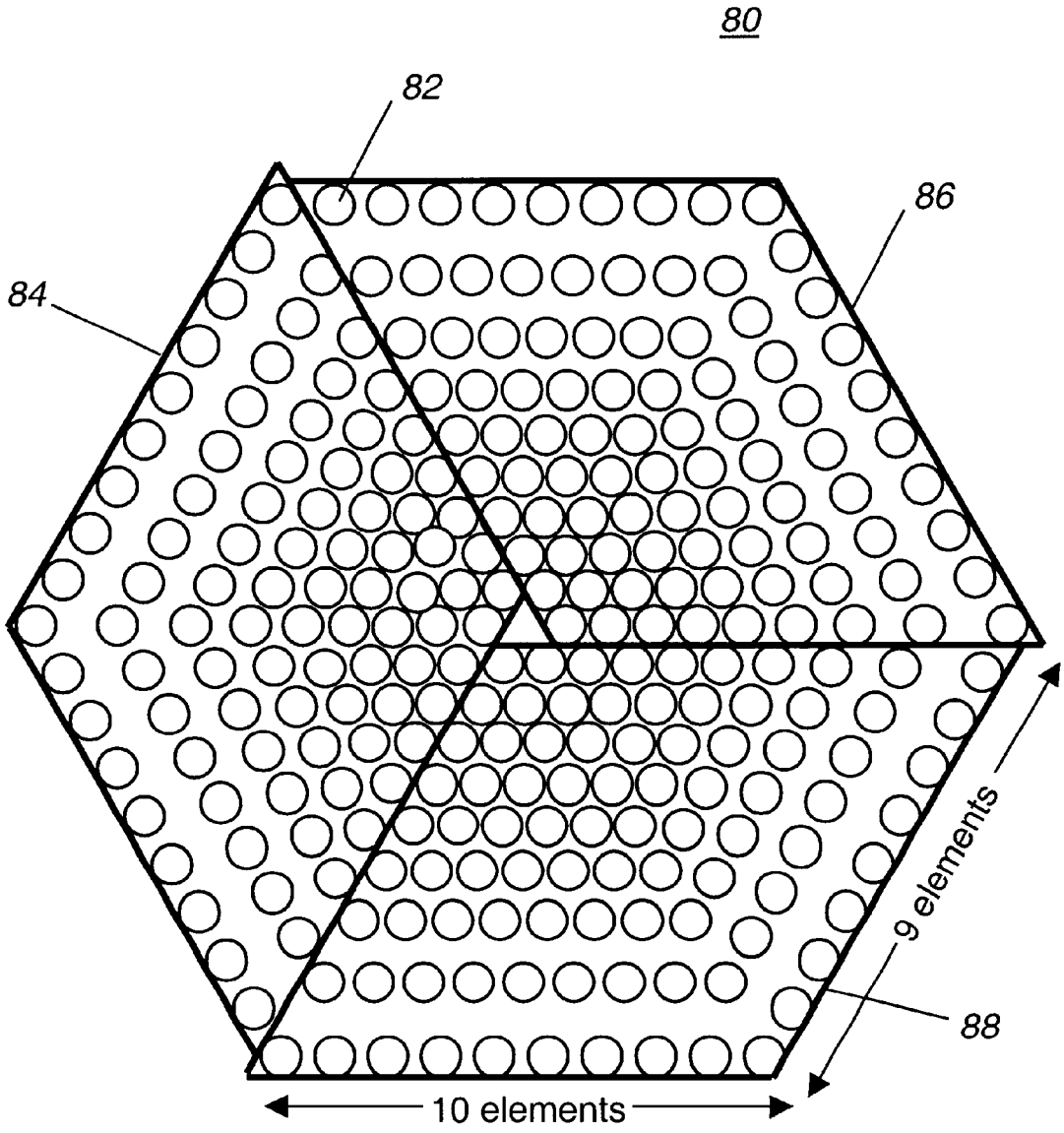
FIG. 12 is an illustration of the partitioning of the antenna elements in a hexagonal antenna element array, where the array includes 270 elements separated into three identical sub-arrays.

FIG. 12 is an illustration of a hexagonal phased antenna array 80 arranged in a density tapered scheme according to the invention. The array 80 is the same as the array 60 with the center antenna element removed. The array 80 is separated into three identical sub-arrays 84, 86 and 88. The array includes 270 elements, where each sub-array 84–88 includes 90 elements. Each sub-array 84–88 includes 10 antenna elements 82 on opposing sides of the sub-array and nine elements 82 on the other opposing sides of the sub-array 84–88. The sub-arrays 84–88 are trapezoidal shaped arrays where the center space is triangular shaped. This design allows the array 80 to be manufactured into three identical sub-arrays to reduce manufacturing costs and the like.

Figure 13:
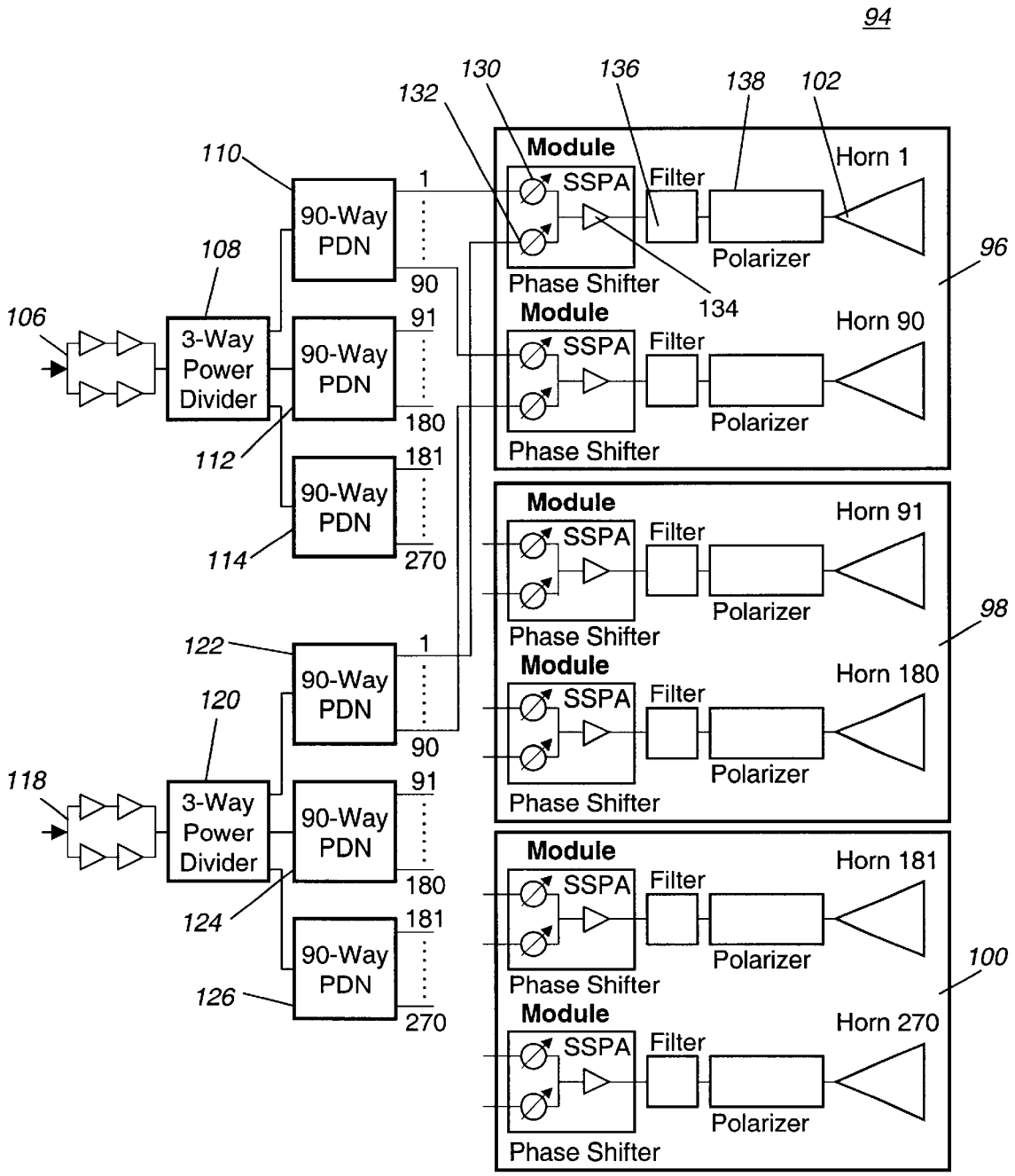
FIG. 13 is a schematic block diagram of a two-beam density-tapered, antenna element array, according to an embodiment of the present invention.

FIG. 13 is a schematic block diagram of a multi-beam antenna system 94 that employs the phased array 80 and emits two separate downlink beams. Each of the sub-arrays 84, 86 and 88 are represented as sub-arrays 96, 98 and 100, and each of the 270 elements 82 are represented as feed horns 102. In this multi-beam application, each feed horn 102 emits part of each of the two beams that are combined with the beams from the other horns that generate the downlink signals. The two beams are separated from each other by carrier frequencies, and may be directed in different directions.

In order to distribute the signal in each beam to each of the 270 horns in the array, a power divider network is necessary. The first beam is sent to a driver amplifier 106 that amplifies the signal. A three-way power divider 108 divides the signal into three separate signals at the same power level. Each of the three signals from the power divider 108 are then sent to three separate 90-way power divider networks (PDN) 110, 112 and 114. Each PDN 110–114 distributes the beam power into ninety separate signals, where one signal is sent to each separate horn 102 in each sub-array 96, 98 and 100. Likewise, the second beam is sent to a driver amplifier 118, a three-way power divider 120, and three 90-way PDNs 122, 124 and 126 in the same manner as the first beam. The PDNs 122–126 also distribute the power to each of the 270 horns 102 in the separate sub-arrays 96, 98 and 100.

Each horn 102 in each sub-array 96–100 includes two phase shifters 130 and 132, a high power amplifier 134, a filter 136 and a polarizer 138. The phase shifter 130 receives the first beam signal from one of the PDNs 110–114 and the second phase shifter 132 receives the second beam signal from one of the PDNs 122–126. The phase shifters 130 and 132 align the particular beam with the predetermined phase progression for that beam. The power amplifier 134 significantly increases the power of the beams for transmission. The filter 136 filters out harmonics and signal noise and the polarizer 138 converts a linearly polarized signal to a circularly polarized signal for transmission if desirable. In this manner, each antenna element 80 separately or simultaneously transmits one of the two signals to be combined with the signals from the other elements 80 in a density-tapered configuration to reduce co-channel interference.

The foregoing discuss discloses and describes merely embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna array system for a satellite communications system, said antenna array system comprising:

a plurality of power amplifiers receiving a signal to be transmitted; and a plurality of antenna elements arranged in a spatial pattern, wherein the elements are arranged in the pattern in concentric rings of elements, each antenna element being connected to one of the power amplifiers and receiving a signal therefrom, said plurality of elements transmitting the signals from all of the elements as a combined signal in a predetermined direction, wherein the antenna elements are arranged in the pattern in a density type arrangement where the elements at a center portion of the pattern are spaced closer together than the elements at an outer portion of the pattern, said combined signal having suppressed side lobes, and wherein the spatial density of the elements is determined by:

$$r_{n+1} = r_n + \frac{d}{f(r_n)}$$

where d is an initial spacing between antenna elements, $r_n$ is the radius of the n-th ring of elements and $f(r_n)$ is a Taylor amplitude distribution at $r_n$, and wherein the number of antenna elements in the n-th ring is equal to 6×(n−1).

2. The system according to claim 1 wherein the pattern is a two-dimensional pattern when viewed from a direction facing an emitting end of the array.

3. The system according to claim 2 wherein the pattern is selected from the group consisting of hexagons, squares, triangles, circles and ellipses.

4. A phased antenna array system for a satellite communications system, said antenna array comprising:

a plurality of power amplifiers receiving a signal to be transmitted; and a plurality of antenna elements arranged in a spatial pattern, wherein the elements are arranged in the pattern in concentric rings of elements, each antenna element being connected to one of the power amplifiers and receiving a signal therefrom, said plurality of elements transmitting the signals from all of the elements as a combined signal in a predetermined direction, wherein the antenna elements are arranged in the pattern in concentric rings in a density taper arrangement in a predetermined spatial density, and wherein the rings of elements proximate a center portion of the pattern are spaced closer together than the rings of elements proximate the outer portion, said pattern being a two-dimensional pattern when viewed from a direction facing an emitting end of the array, said combined signal having supressed sidelobes, and wherein the spatial density of the elements is determined by:

$$r_{n+1} = r_n + \frac{d}{f(r_n)}$$

where d is an initial spacing between antenna elements, $r_n$ is the radius of the n-th ring of elements and $f(r_n)$ is a Taylor amplitude distribution at $r_n$, and wherein the number of antenna elements in the n-th ring is equal to 6×(n−1).

5. The system according to claim 4 wherein the pattern of antenna elements includes three identical sub-patterns arranged around a center space, each sub-pattern including the same number of antenna elements.

6. The system according to claim 5 wherein the pattern has a hexagonal shape and each sub-pattern has a trapezoidal shape.

7. The system according to claim 5 wherein each sub-pattern includes nine antenna elements on one set of opposing sides and ten elements on the other set of opposing sides.

8. The system according to claim 4 wherein the pattern is selected from the group consisting of hexagons, squares, triangles, circles and ellipses.

9. An antenna array system for a satellite communications system, said antenna array system comprising:

a plurality of power amplifiers receiving a signal to be transmitted; and a plurality of antenna elements arranged in a spatial pattern, wherein the elements are arranged in the pattern in concentric rings of elements, each antenna element being connected to one of the power amplifiers and receiving a signal therefrom, said plurality of elements transmitting the signals from all of the elements as a combined signal in a predetermined direction, wherein the antenna elements are arranged in the pattern in a density type arrangement where the elements at a center portion of the pattern are spaced closer together than the elements at an outer portion of the pattern, said combined signal having suppressed side lobes, and wherein the pattern of antenna elements includes three identical sub-patterns arranged around a center space, each sub-pattern including the same number of antenna elements, and wherein the spatial density of the elements is determined by:

$$r_{n+1} = r_n + \frac{d}{f(r_n)}$$

where d is an initial spacing between antenna elements, $r_n$ is the radius of the n-th ring of elements and $f(r_n)$ is a Taylor amplitude distribution at $r_n$;

and wherein the number of antenna elements in the n-th ring is equal to 6×(n−1).

10. An antenna array for transmitting a satellite downlink signal, said array comprising a plurality of antenna elements arranged in a spatial pattern, wherein the antenna elements are arranged in the pattern in concentric rings of elements and in a density taper arrangement where the elements at a center portion of the pattern are spaced closed together than the elements at an outer portion of the pattern to suppress side lobes in the downlink signal, and wherein the spatial density of the elements is determined by:

$$r_{n+1} = r_n + \frac{d}{f(r_n)}$$

where d is an initial spacing between antenna elements, $r_n$ is the radius of the n-th ring of elements and $f(r_n)$ is a Taylor amplitude distribution at $r_n$;

and wherein the number of antenna elements in the n-th ring is equal to 6×(n−1).

* * * * *